US011784390B2

(12) United States Patent
Colapietro et al.

(10) Patent No.: US 11,784,390 B2
(45) **Date of Patent: *Oct. 10, 2023**

(54) MOUNTING CONFIGURATION FOR SMALL CELL ANTENNA ASSEMBLY

(71) Applicant: CommScope Technologies LLC, Hickory, NC (US)

(72) Inventors: Julian R. Colapietro, McKinney, TX (US); Michael S. McFall, McKinney, TX (US); Ulrich A. Gienger, Fairview, TX (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/704,805

(22) Filed: Mar. 25, 2022

(65) Prior Publication Data

US 2022/0216584 A1 Jul. 7, 2022

Related U.S. Application Data

(63) Continuation of application No. 16/887,157, filed on May 29, 2020, now Pat. No. 11,362,410.

(60) Provisional application No. 62/858,564, filed on Jun. 7, 2019.

(51) Int. Cl.
*H01Q 1/12* (2006.01)
*H01Q 1/44* (2006.01)

(52) U.S. Cl.
CPC ..... *H01Q 1/1242* (2013.01); *H01Q 1/44* (2013.01)

(58) Field of Classification Search
CPC ..... H01Q 1/1242; H01Q 1/44; H01Q 1/1228
See application file for complete search history.

(56) References Cited

U.S. PATENT DOCUMENTS

| | | | |
|---|---|---|---|
| 6,222,504 | B1 | 4/2001 | Oby |
| 9,698,477 | B1 | 7/2017 | Jabara et al. |
| 10,505,271 | B2 | 12/2019 | Constance et al. |
| 10,947,751 | B2 | 3/2021 | Lockwood et al. |
| 11,362,410 | B2 * | 6/2022 | Colapietro ..... H01Q 1/1228 |
| 2012/0132781 | A1 | 5/2012 | Kolokotronis |
| 2016/0336641 | A1 | 11/2016 | Dipiero |

* cited by examiner

*Primary Examiner* — Seung H Lee
(74) *Attorney, Agent, or Firm* — Myers Bigel, P.A.

(57) ABSTRACT

A mounting flange for a monopole includes a generally annular main panel surrounding a central hole. The main panel includes a plurality of first mounting holes that are substantially circumferentially equidistant from each other and at a first radial distance from a center of the central hole. The main panel also includes a plurality of second mounting holes that are substantially circumferentially equidistant from each other and at a second radial distance from a center of the central hole, the second distance being greater than the first distance.

13 Claims, 5 Drawing Sheets

MOUNTING CONFIGURATION FOR SMALL CELL ANTENNA ASSEMBLY

RELATED APPLICATION

The present application is a continuation of and claims priority to U.S. patent application Ser. No. 16/887,157 filed on May 29, 2020 which claims priority from and the benefit of U.S. Provisional Patent Application No. 62/858,564 filed on Jun. 7, 2019, the disclosure of each of which is hereby incorporated herein in its entirety.

FIELD OF THE INVENTION

The present invention is directed generally toward communication antennas, and more particularly to mounting structures for communication antennas.

BACKGROUND

As wireless data service demands have grown, a conventional response has been to increase the number and capacity of conventional cellular Base Stations Macro-Cells). The antennas used by such Macro-Cells are typically mounted on antenna towers. A conventional antenna tower has three or four legs on which antennas and supporting remote radio units (RRUs) are mounted. However, in some environments structures known as "monopoles" are used as mounting structures. Monopoles are typically employed when fewer antennas/RRUs are to be mounted, and/or when a structure of less height is required.

In addition, Macro-Cell sites are becoming less available, and available spectrum limits how much additional capacity can be derived from a given Macro-Cell. Accordingly, small cell RRU and antenna combinations have been developed to "fill in" underserved or congested areas that would otherwise be within a Macro-Cell site. Deployment of small cells, particularly in urban environments, is expected to continue to grow. Often such small cell configurations (sometimes termed "metrocells") are mounted on monopoles.

In view of the foregoing, it may be desirable to provide additional monopole arrangements, particularly in mounting.

SUMMARY

As a first aspect, embodiments of the invention are directed to a mounting flange for a monopole. The mounting flange comprises: a generally annular main panel surrounding a central hole. The main panel includes a plurality of first mounting holes that are substantially circumferentially equidistant from each other and at a first radial distance from a center of the central hole. The main panel further includes a plurality of second mounting holes that are substantially circumferentially equidistant from each other and at a second radial distance from a center of the central hole, the second distance being greater than the first distance.

As a second aspect, embodiments of the invention are directed to a monopole assembly for mounting antennas comprising: an elongate monopole having an upper end; and a mounting flange attached to the upper end of the monopole. The mounting flange comprises a generally annular main panel surrounding a central hole that aligns with an internal lumen of the monopole. The main panel includes a plurality of first mounting holes that are substantially circumferentially equidistant from each other and at a first radial distance from a center of the central hole. The main panel further includes a plurality of second mounting holes that are substantially circumferentially equidistant from each other and at a second radial distance from a center of the central hole, the second distance being greater than the first distance.

As a third aspect, embodiments of the invention are directed to a mounting flange for a monopole comprising a generally annular main panel surrounding a central hole. The main panel includes three first mounting holes that are substantially circumferentially equidistant from each other and at a first radial distance of between about 5.5 and 6 inches from a center of the central hole. The main panel further includes six second mounting holes that are substantially circumferentially equidistant from each other and at a second radial distance of between about 6 and 6.5 inches from a center of the central hole.

DETAILED DESCRIPTION

Figure 1:
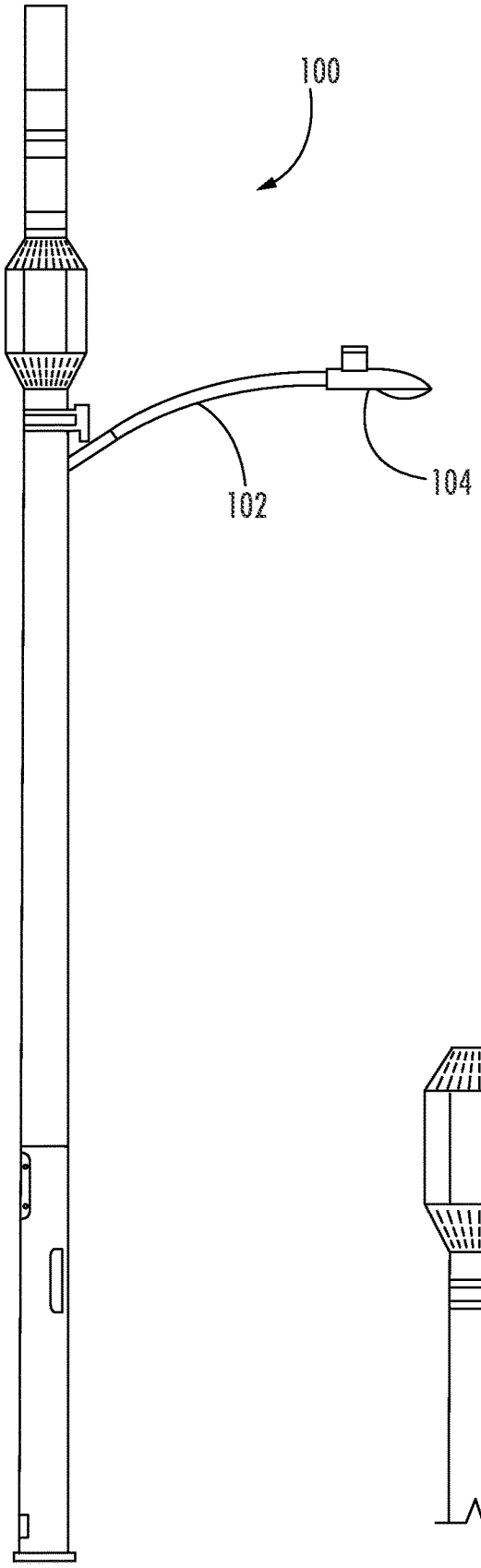
FIG. 1 is a front view of a conventional monopole according to embodiments of the invention.

The present invention will now be described more fully hereinafter, in which embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and or groups thereof. As used herein the expression "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. The device may be otherwise oriented (rotated 90 degrees or at other orientations) and the spatially relative descriptors used herein interpreted accordingly.

Well-known functions or constructions may not be described in detail for brevity and/or clarity.

Figure 2:
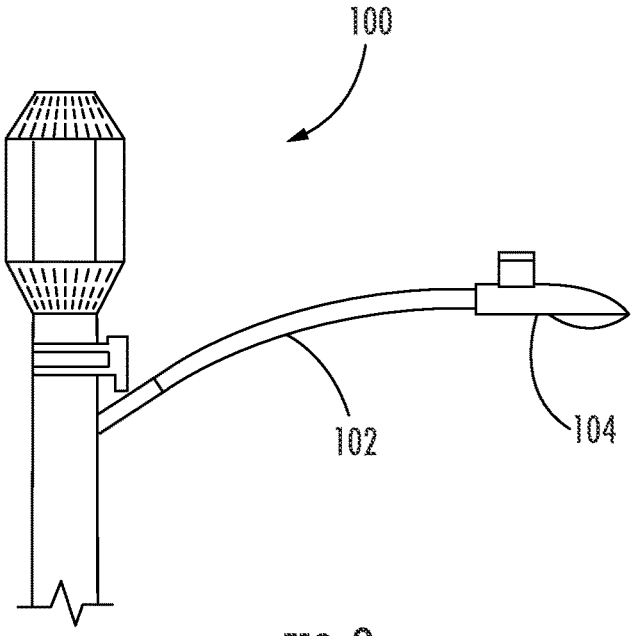
FIG. 2 is a slightly enlarged front view of the monopole of FIG. 1.

Referring now to the drawings, a telecommunications monopole designated at 100 is shown in FIGS. 1 and 2. As can be seen in FIG. 2, the monopole 100, which is sized as a "metrocell" having a diameter of between about 8 to 20 inches and a height of between about 20 and 40 feet, is styled as a streetlight; an arm 102 that mounts a luminaire 104 (such as an LED streetlight) is also included, but may be absent in other embodiments.

Figure 3:
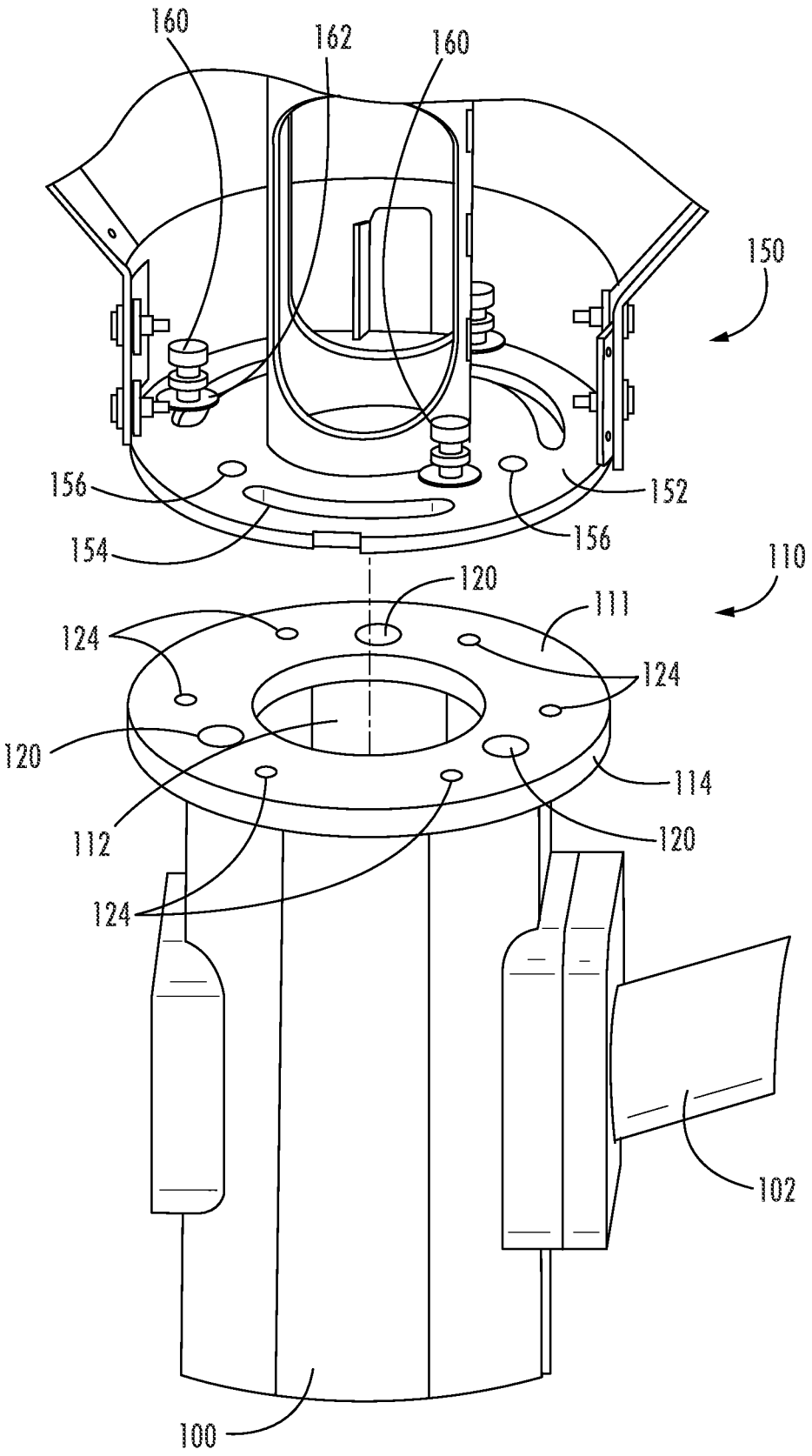
FIG. 3 is an exploded perspective view of an antenna module and a mounting flange at the top of a monopole of FIG. 1.
Figure 4:
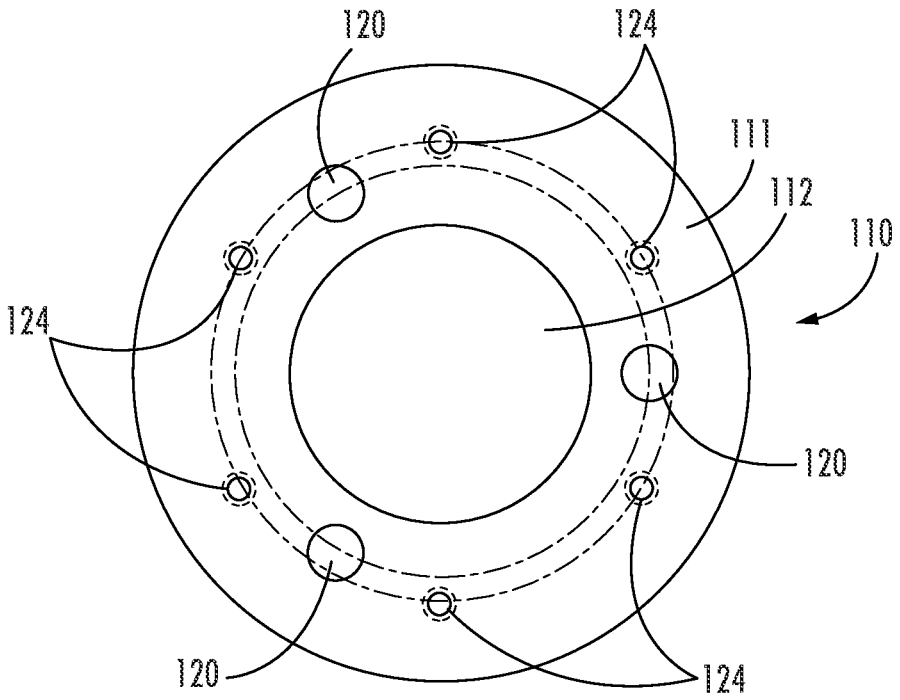
FIG. 4 is a top view of the mounting flange shown on the monopole of FIG. 3.
Figure 5:
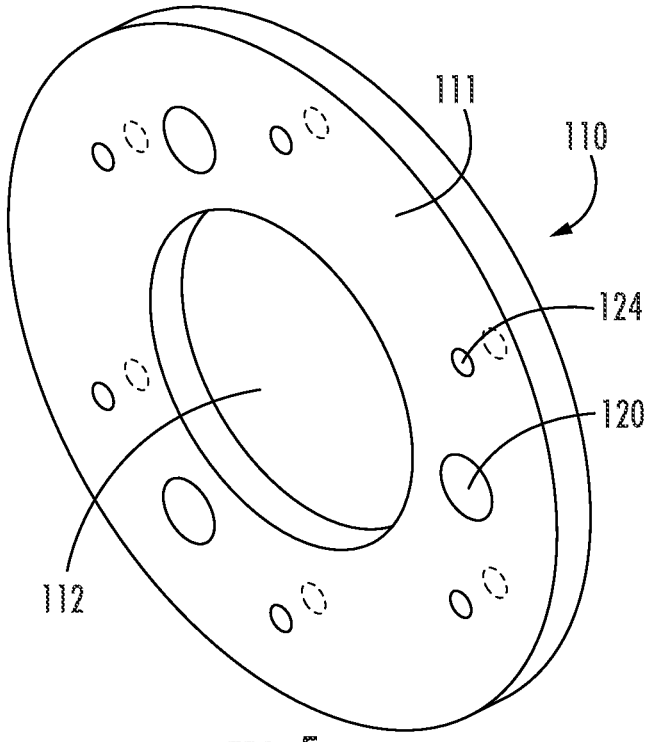
FIG. 5 is a perspective view of the mounting flange of FIG. 4.

As can be seen in FIG. 3, a mounting flange 110 is attached (typically via welding) at the top of the monopole 100. As can be seen in FIGS. 4 and 5, the mounting flange 110 is generally annular, with a main panel 111 surrounding a central hole 112 that provides an opening into the lumen of the monopole 100 to permit the routing of cables therethrough. The outer edge 114 of the main panel 111 extends radially beyond the perimeter of the monopole 100. In some embodiments, the mounting flange 110 is between about 8 and 9 inches in diameter, with a range of 8.1 to 8.5 inches being suitable for certain embodiments. In some embodiments, the central hole 112 is between about 3 and 5 inches in diameter, with a range of 3.75 to 4.25 inches being suitable for certain embodiments.

The mounting flange 110 includes three mounting holes 120. The mounting holes 120 are spaced substantially circumferentially equidistant from each other (i.e., they are located about 120 degrees from each other). In some embodiments, the centers of the mounting holes 120 are located at a radial distance of about 5.5 to 6 inches from the center of the central hole 112, with a distance of 5⅝ inches being suitable for certain embodiments. The mounting holes 120 are typically between about ⅝ and ⅞ inch in diameter, with ¾ inch mounting holes 120 being employed in some embodiments.

The mounting flange 110 also includes six mounting holes 124. The mounting holes 124 are spaced substantially circumferentially equidistant from each other (i.e., they are located about 60 degrees from each other). In some embodiments, the centers of the mounting holes 124 are located at a radial distance of about 6 to 6.5 inches from the center of the central hole 112, with a distance of 6¼ inches being suitable for certain embodiments. The mounting holes 124 are typically between about 5/16 and 7/16 inch in diameter, with ⅜ inch mounting holes 124 being employed in some embodiments. Also, in the described embodiment, the mounting holes 124 are tapped with threads, with a 16 UNC thread being suitable for some embodiments.

As can be seen in FIG. 3, the mounting flange 110 can be employed to attach an antenna module 150 to the monopole 100. The antenna module 150 has a mounting plate 152 with three arcuate slots 154, each of which is approximately ⅝ inch in width, is positioned radially about 5.5 to 6 inches from the center of the mounting plate 152, and extends for between about 40 and 90 degrees. The mounting plate 152 also includes three cable access holes 156 that are located between the slots 154.

As can be envisioned from FIG. 3, the antenna assembly 150 can be mounted on the mounting flange 110 via three bolts 160 and mating nuts 162. The bolts 160 are inserted from above through the slots 154 in the mounting plate 152, then through the mounting holes 120 in the mounting flange 110. The nuts 162 are threaded onto the bolts 160. The antenna assembly 150 (which typically includes three antenna arrays oriented 120 degrees from each other) can be rotated relative to the mounting flange 110 to a desired orientation, at which point the nuts 162 can be tightened onto the bolts 160 to secure the antenna assembly 150 in place.

Figure 6:
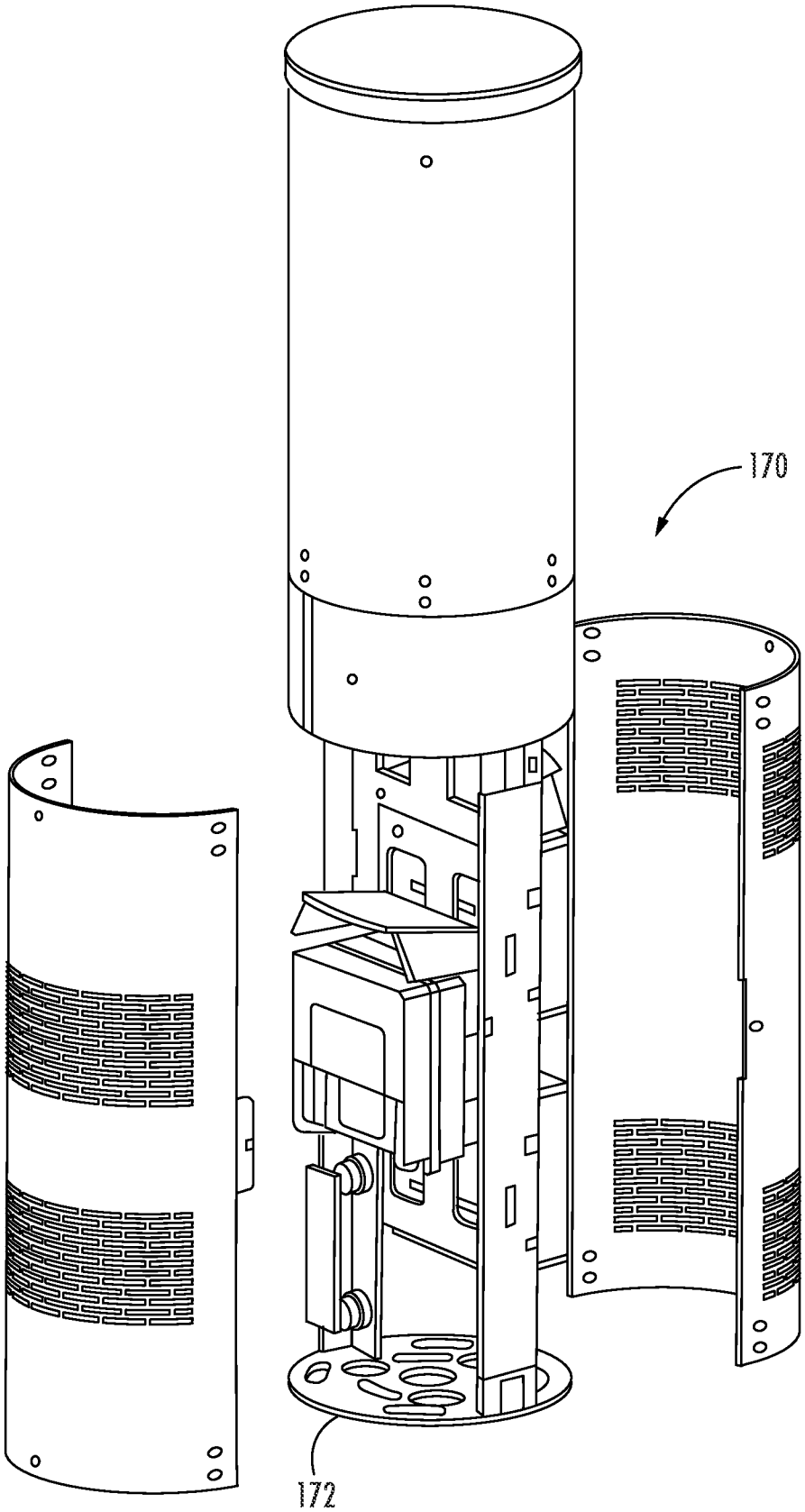
FIG. 6 is an exploded perspective view of an alternative antenna module that can be employed with the mounting flange of FIG. 4.
Figure 7:
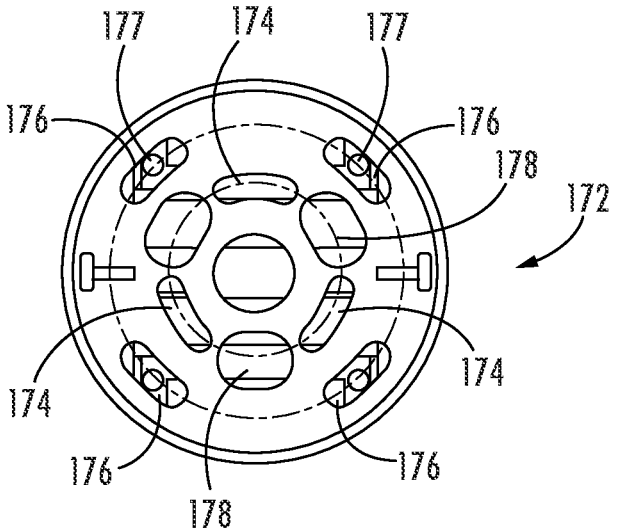
FIG. 7 is a top view of the mounting plate of the antenna module of FIG. 6.

Referring to FIGS. 6 and 7, the mounting flange 110 can also be employed to attach an antenna module 170 to the monopole. The antenna module 170 includes a mounting plate 172 (best seen in FIG. 7). The mounting plate 172 includes three arcuate mounting slots 174, and also includes four mounting slots 176 that are positioned radially outward of the mounting slots 174. The mounting plate 170 also includes "kidney-shaped" cable access holes 178 between each pair of mounting slots 174.

As can be seen from FIGS. 6 and 7, the antenna assembly 170 can be attached to the mounting flange 110 by positioning the mounting plate 172 such that the mounting slots 174 align with the mounting holes 124. Threaded screws 177 are then inserted through the mounting holes 174 and into the mounting holes 124 to secure the antenna assembly 170 in place.

The foregoing demonstrates that the configuration of the mounting flange 110 can enable multiple antenna assemblies (such as the antenna assemblies 150, 170) to be mounted atop a monopole. This flexibility can reduce manufacturing, labor and inventory costs and time for the monopole.

Figure 8:
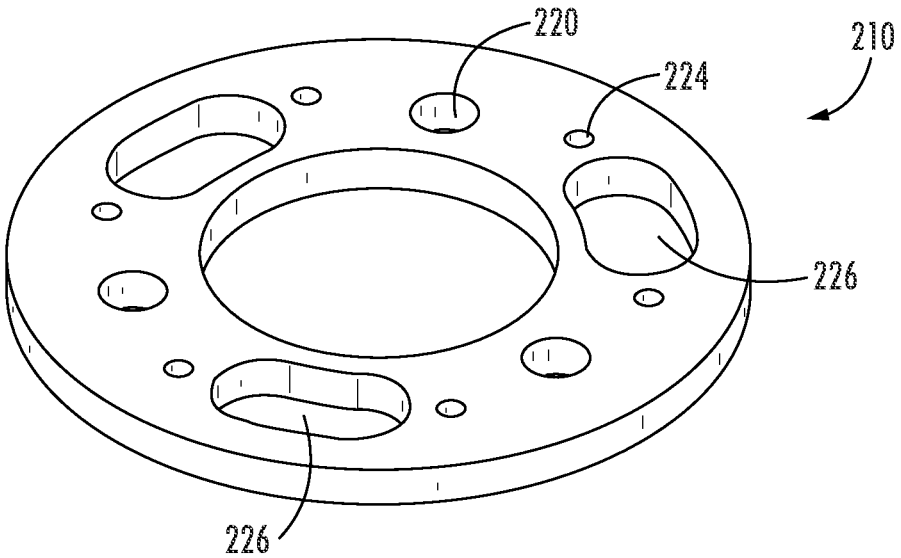
FIG. 8 is a perspective view of a mounting flange according to alternative embodiments of the invention.

As another option, another mounting flange, designated broadly at 210, is shown in FIG. 8. The mounting flange 210 is similar to the mounting flange 110, having mounting holes 220, 224 that are similarly arranged to the mounting holes 120, 124 of the mounting flange 110, but the mounting flange 210 also includes three cable access holes 226 that are positioned generally between adjacent mounting holes 224.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A combination, comprising:

a vertically-disposed member having upper and lower ends; and a mounting flange comprising:

a generally annular main panel surrounding a central hole, the main panel welded to the upper end or the lower end of the vertically-disposed member;

wherein the main panel includes a plurality of round first mounting holes that are circumferentially equidistant from each other and at a first radial distance from a center of the central hole; and wherein the main panel includes a plurality of round second mounting holes that are circumferentially equidistant from each other and at a second radial distance from a center of the central hole, the second distance being greater than the first distance.

2. The combination defined in claim 1, wherein the first radial distance is between about 5.5 and 6 inches, and the second radial distance is between about 6 and 6.5 inches.

3. The combination defined in claim 1, wherein the plurality of first mounting holes comprises three first mounting holes, and the plurality of second mounting holes comprises six second mounting holes.

4. The combination defined in claim 1, wherein the plurality of second mounting holes comprises threaded mounting holes.

5. The combination defined in claim 1, wherein the first mounting holes have a diameter that varies from a diameter of the second mounting holes.

6. A combination, comprising:

a vertically-disposed member having an upper end;

a telecommunications assembly; and a mounting flange attached to the upper end or the lower end of the vertically-disposed member, the mounting flange comprising a generally annular main panel surrounding a central hole that aligns with an internal lumen of the monopole;

wherein the main panel includes a plurality of round first mounting holes that are circumferentially equidistant from each other and at a first radial distance from a center of the central hole; and wherein the main panel includes a plurality of round second mounting holes that are circumferentially equidistant from each other and at a second radial distance from a center of the central hole, the second distance being greater than the first distance;

wherein the telecommunications assembly is mounted to the mounting flange employing ether the first plurality of mounting holes or the second plurality of mounting holes, and wherein the telecommunications assembly is mounted directly above the vertically-disposed member and the mounting flange.

7. The combination defined in claim 6, wherein the first radial distance is between about 5.5 and 6 inches, and the second radial distance is between about 6 and 6.5 inches.

8. The combination defined in claim 6, wherein the plurality of first mounting holes comprises three first mounting holes, and the plurality of second mounting holes comprises six second mounting holes.

9. The combination defined in claim 6, wherein the plurality of second mounting holes comprises threaded mounting holes.

10. The combination defined in claim 6, wherein the first mounting holes have a diameter that varies from a diameter of the second mounting holes.

11. The combination defined in claim 6, wherein the telecommunications assembly comprises a plurality of antennas.

12. The combination defined in claim 11, wherein the telecommunications assembly is mounted to the mounting flange via fasteners inserted in the plurality of first mounting holes.

13. The combination defined in claim 11, wherein the telecommunications assembly is mounted to the mounting flange via fasteners inserted in the plurality of second mounting holes.

* * * * *